US008500252B2

(12) United States Patent
Shibata

(10) Patent No.: US 8,500,252 B2
(45) Date of Patent: Aug. 6, 2013

(54) LIQUID EJECTION HEAD AND METHOD OF MANUFACTURING THE SAME

(75) Inventor: Takeshi Shibata, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/281,701

(22) Filed: Oct. 26, 2011

(65) Prior Publication Data

US 2012/0113198 A1 May 10, 2012

(30) Foreign Application Priority Data

Nov. 5, 2010 (JP) ..... 2010-248548

(51) Int. Cl.
*B41J 2/05* (2006.01)

(52) U.S. Cl.
USPC ..... 347/65

(58) Field of Classification Search
USPC ..... 347/65, 66, 85, 86, 87
See application file for complete search history.

(56) References Cited

U.S. PATENT DOCUMENTS 5,478,606 A * 12/1995 Ohkuma et al. ..... 427/555
6,254,229 B1 * 7/2001 Bohorquez et al. ..... 347/93
7,275,310 B2 * 10/2007 Suzuki ..... 29/611

FOREIGN PATENT DOCUMENTS

JP 2001-10080 A 1/2001

* cited by examiner

*Primary Examiner* — Anh T. N. Vo
(74) *Attorney, Agent, or Firm* — Fitzpatrick, Cella, Harper & Scinto

(57) ABSTRACT

A liquid ejection head includes an ejection element substrate having an energy generating element, an ejection orifice for ejecting a liquid, and a liquid supply port communicatively connected to the ejection orifice; and a support member supporting the ejection element substrate and having a liquid guide path for supplying the liquid to the liquid supply port. The support member is formed by baking a laminate including at least one guide path plate having a through-hole for constituting a part of the liquid guide path, a filter plate having an opening for disposing a filter member for filtering the liquid, and a filter member disposed in the opening.

15 Claims, 6 Drawing Sheets

LIQUID EJECTION HEAD AND METHOD OF MANUFACTURING THE SAME

BACKGROUND OF THE INVENTION

1. Field of the Invention

The present invention relates to a liquid ejection head and a method of manufacturing the same.

2. Description of the Related Art

There has been known an inkjet recording head for recording by ejecting an ink from an ejection orifice to a recording medium disclosed in Japanese Patent Application Laid-Open No. 2001-010080.

More specifically, Japanese Patent Application Laid-Open No. 2001-010080 discloses an inkjet recording head having a support member made of ceramics or the like. The inkjet recording head is configured such that a support member supports an ejection element substrate including a substrate or a base material having an ejection energy generating element and an ink ejection orifice. A supply port for supplying a liquid to the ejection energy generating element is disposed in the substrate or the base material so as to penetrate through the substrate. In addition, the support member also has a through-hole. The support member and the substrate are bonded to each other so as to sandwich therebetween a filter member for filtering contaminants from ink. The ink passes through the filter when supplied from an ink cartridge to the supply port through a through-hole of the support member.

Meanwhile, a full line type inkjet recording head requires an elongated support member made of alumina or the like. In prior arts, there has been known an inkjet recording head having an elongated support member which is formed by laminating and integrating a plurality of plates so as not to impair the flatness of the surface of the support member on which the recording element substrate is to be disposed.

In the inkjet recording head disclosed in Japanese Patent Application Laid-Open No. 2001-010080, the support member is bonded to the filter as a separate part with an adhesive, and there is concern that the manufacturing process for the inkjet recording head becomes complicated.

In addition, the full line type inkjet recording head may cause concern about the bonding strength between the filter and the support member because the constituent parts are increasingly affected by thermal expansion due to the large-size of the filter and the support member. Further, there is also concern that the manufacturing process becomes complicated because an additional process of bonding the support member to the filter is required.

SUMMARY OF THE INVENTION

Thus, it is an object of the present invention to provide a liquid ejection head having an increased bonding strength between a filter and a support member, which is a laminate formed of a plurality of constituent members, and additionally having a simple configuration to prevent contaminants in a liquid such as ink from entering an ejection element substrate.

It is another object of the present invention to provide a method of manufacturing such a liquid ejection head with good precision.

According to an aspect of the present invention, there is provided a liquid ejection head including: an ejection element substrate having an energy generating element for generating energy for ejecting a liquid, an ejection orifice for ejecting the liquid, and a liquid supply port communicatively connected to the ejection orifice; and a support member supporting the ejection element substrate and having a liquid guide path for supplying the liquid to the liquid supply port, wherein the support member is formed by baking a laminate including at least one guide path plate having a through-hole for constituting a part of the liquid guide path, a filter plate having an opening for disposing a filter member for filtering the liquid, and a filter member disposed in the opening.

According to another aspect of the present invention, there is provided a method of manufacturing a liquid ejection head including: an ejection element substrate having an energy generating element for generating energy for ejecting a liquid, an ejection orifice for ejecting the liquid, and a liquid supply port communicatively connected to the ejection orifice; and a support member supporting the ejection element substrate and having a liquid guide path for supplying the liquid to the liquid supply port, the method including the steps of: (1) preparing a laminate including at least one guide path plate having a through-hole constituting a part of the liquid guide path, a filter plate having an opening for disposing a filter member for filtering the liquid, and a filter member disposed in the opening; and (2) integrating by baking the laminate.

According to a further aspect of the present invention, there is provided a method of manufacturing a liquid ejection head including: an ejection element substrate having an energy generating element for generating energy for ejecting a liquid, an ejection orifice for ejecting the liquid, and a liquid supply port communicatively connected to the ejection orifice; and a support member supporting the ejection element substrate and having a liquid guide path for supplying the liquid to the liquid supply port, the method including the steps of: (1) preparing a laminate including at least one guide path plate having a through-hole constituting a part of the liquid guide path, a filter plate having an opening for disposing a filter substrate for filtering the liquid, and a filter substrate disposed in the opening; (2) integrating by baking the laminate; (3) polishing a surface of the filter plate; and (4) perforating the filter substrate to form a filter member, in this order.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

A liquid ejection head according to the present invention includes an ejection element substrate having an energy generating element for generating energy for ejecting a liquid and a liquid ejection orifice. Further, the liquid ejection head according to the present invention includes a support member bonded to the ejection element substrate, which support member supports the ejection element substrate and has a liquid guide path serving as a liquid passage for supplying a liquid to the ejection element substrate.

The support member is obtained by baking and integrating a laminate including at least one guide path plate having a through-hole for constituting a part of the liquid guide path, a filter plate having an opening for disposing a filter member, and a filter member disposed in the opening.

Now, embodiments of the present invention will be described in detail. Note that the present invention is not limited to the following embodiments.

Note also that the following description will focus on the inkjet recording head as an example of applying the present invention, but the scope of the present invention is not limited to this. For example, the present invention is applicable to a liquid ejection head for use in biochip production and electronic circuit printing. The liquid ejection head may include not only an inkjet recording head but also a head for manufacturing a color filter.

(First Embodiment)

Now, a first embodiment of the present invention will be described.

Figure 1:
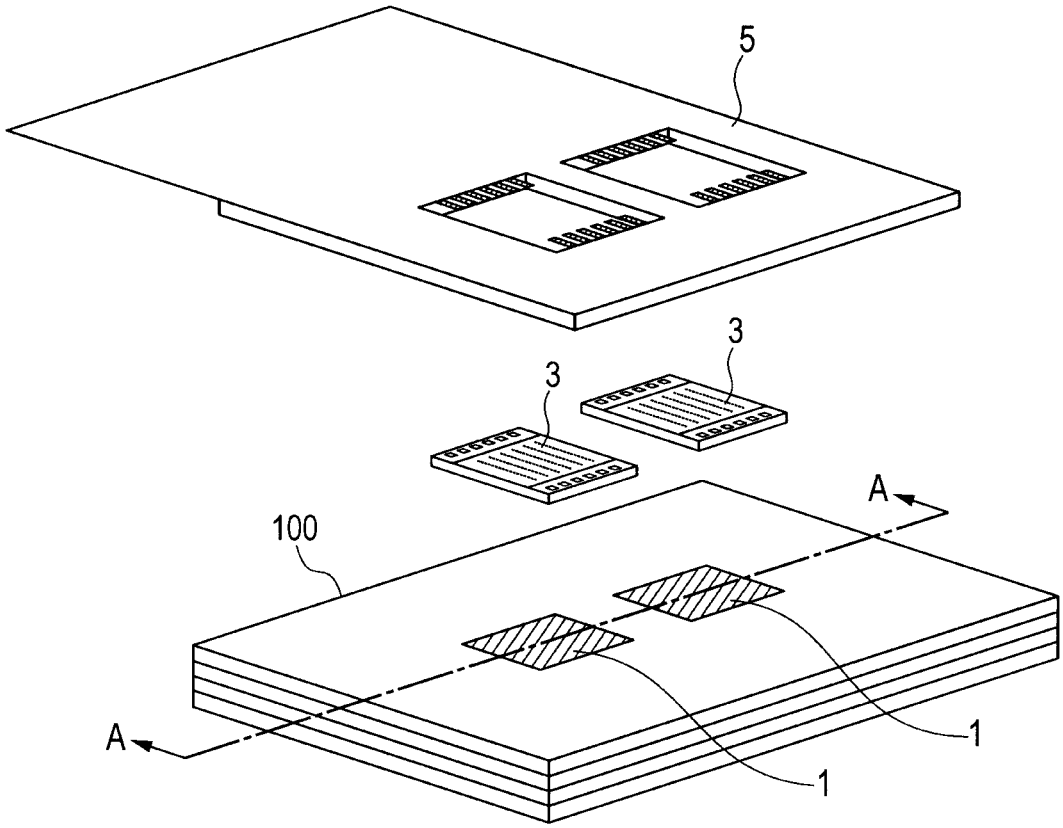
FIG. 1 is an exploded perspective view of an inkjet recording head according to a first embodiment of the present invention.
Figure 2:
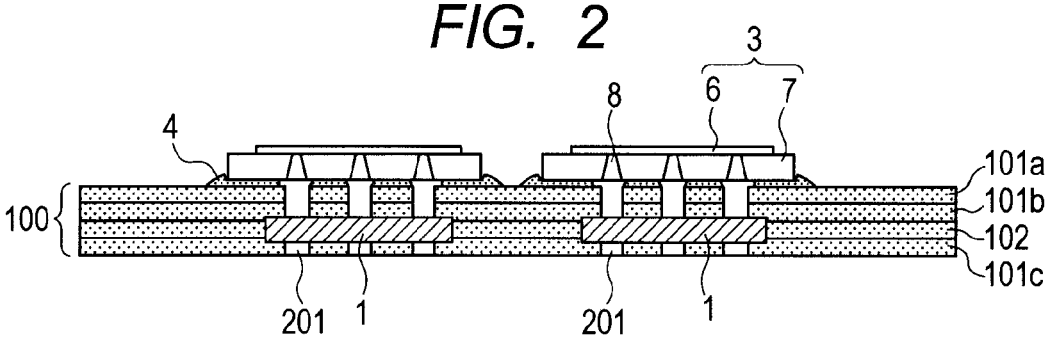
FIG. 2 is a schematic sectional view of the inkjet recording head illustrated in FIG. 1.

FIG. 1 is an exploded perspective view of an inkjet recording head. FIG. 2 is a vertical sectional view taken along line A-A of FIG. 1.

As illustrated in FIG. 2, an ejection element substrate 3 is bonded to a support member 100 with an adhesive 4. The ejection element substrate 3 mainly includes a flow path forming member 6 and a base material 7. The flow path forming member 6 includes an ejection orifice for ejecting a liquid such as ink and a liquid supply port (not shown) communicatively connected to the ejection orifice. The base 7 has on the upper surface an energy generating element (not shown) for generating energy for ejecting a liquid such as ink. Further, the base 7 has a liquid supply port 8 for supplying a liquid such as ink to the liquid flow path.

The ejection element substrate 3 is disposed such that a surface in which the liquid supply port is opened, namely, the lower surface thereof is supported by the support member 100 in FIG. 2. The support member 100 has a liquid guide path 201 for supplying a liquid such as ink to the liquid supply port 8. The liquid guide path 201 is communicatively connected to the liquid supply port 8. In the cross section of FIG. 2, one ejection element substrate 3 has a plurality of liquid supply ports 8 and a liquid guide path 201 is disposed corresponding to each of the plurality of liquid supply ports 8.

The support member is formed by baking a laminate including at least one guide path plate, a filter plate, and a filter member. The guide path plate has a through-hole constituting a part of the liquid guide path. The filter plate has an opening for disposing a filter member and a filter member is disposed in the opening. In FIG. 2, the laminate includes a first guide path plate 101*a*, a second guide path plate 101*b*, a filter plate 102, and a third guide path plate 101*c* in the order from above. Through-holes provided in the guide path plates are communicatively connected to each other to form a liquid guide path 201. Every liquid guide path 201 is connected to the filter member. Thus, the liquid supplied from an ink tank or the like is sure to be filtered by the filter member. In the cross section of FIG. 2, one filter member is disposed for the plurality of liquid guide paths reaching one ejection element substrate 3.

In FIG. 2, the upper surface of the filter member 1 disposed in an opening of the filter plate 102 is in contact with the lower surface of the second guide path plate. The lower surface of the filter member 1 is in contact with the upper surface of the third guide path plate. Note that in the present description, one side of the support member on which the ejection element substrate is disposed is referred to as an upward direction and the other side of the support member is referred to as a downward direction.

An electric wiring substrate 5 is joined to the ejection element substrate 3 so as to be electrically connected to the printer main body apparatus. The joint portion between the ejection element substrate 3 and the electric wiring substrate 5 is sealed, for example, with a thermosetting resin for protection (not shown).

The filter member may be disposed one for one corresponding to each of the plurality of ejection element substrates. Further, the support member may preferably have one filter member for the plurality of liquid guide paths for supplying a liquid to one ejection element substrate.

It is preferred that the support member region to which the ejection element substrate 3 is to be joined has an increased surface precision of about 5 μm.

The guide path plate and the filter plate may preferably be made of alumina, which is a low linear expansion material hardly affected by a change in shape due to heat.

The inkjet recording head according to the present embodiment is configured such that the filter member 1 is formed in the filter plate 102 of the support member 100 for every ejection element substrate 3. This configuration allows the inkjet recording head to be designed such that the ink passing through the liquid guide path 201 is sure to pass through the filter member 1.

The filter member 1 may preferably be made of an alloy of Fe, Cr, and Ni. Alternatively, the filter member 1 may preferably be made of a low linear expansion material, such as alumina and zirconia.

Figure 3A:
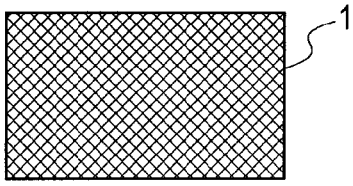
FIGS. 3A and 3B are schematic top views illustrating a shape of a filter member.
Figure 3B:
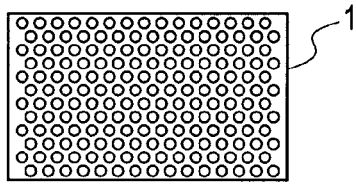

The filter member 1 has a filtering function. The shape of the filter member includes a mesh and a hole pattern as illustrated in FIGS. 3A and 3B respectively. The hole diameter of the filter can be set to be smaller than a minimum opening area of the ejection orifice for ejecting ink, such as 6 μm or less.

Referring to FIGS. 4A, 4B, 4C, and 4D, a method of forming the filter member 1 in the support member 100 will be described.

Figure 4A:
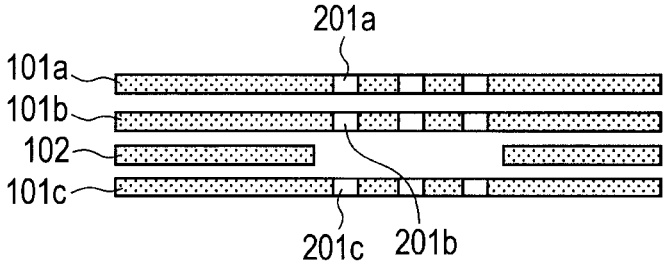
FIGS. 4A, 4B, 4C, and 4D are sectional views for describing the process of manufacturing the inkjet recording head according to the present embodiment.

As illustrated in FIG. 4A, a first guide path plate 101*a*, a second guide path plate 101*b*, a filter plate 102, and a third guide path plate 101*c* are prepared. A first through-hole 201*a* serving as a part of the liquid guide path is formed in the first guide path plate. Likewise, a second through-hole 201*b* and a third through-hole 201*c* each serving as a part of the liquid guide path are formed in the second guide path plate and the third guide path plate, respectively.

Figure 4B:
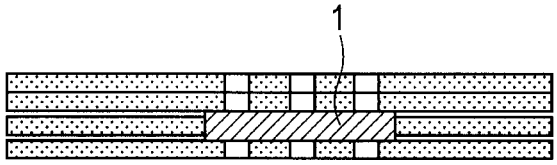

Then, as shown in FIG. 4B, a filter member 1 is disposed in a filter opening of the filter plate 102. Then, the first guide path plate 101*a*, the second guide path plate 101*b*, the filter plate 102 having the filter member 1 therein, and the third guide path plate 101*c* are stacked in this order from above. The above plates are stacked such that the first through-hole 201*a*, the second through-hole 201*b* and the third through-hole 201*c* are communicatively connected to each other.

The filter member 1 is set to be thicker than the filter plate 102. This setting allows an inter-plate gap to be eliminated when the plates are pressed in a baking process described later.

Figure 4C:
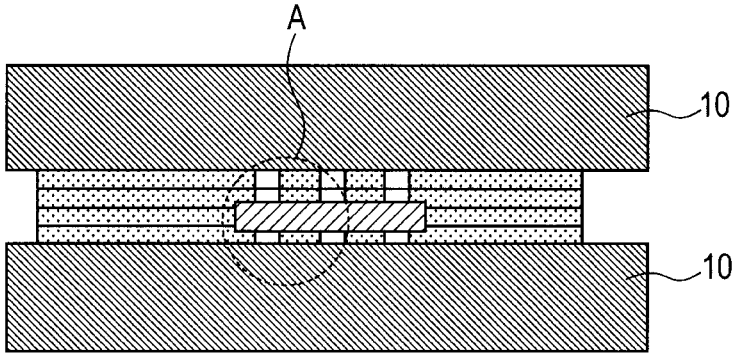

Then, as illustrated in FIG. 4C, the laminate is integrated by baking the same while pressing. Specifically, a plurality of the plates can be pressed with a pressing/baking jig 10 in such a way that the filter member 1 can eliminate a gap between the second guide path plate 101*b* and the third guide path plate 101*c*.

The baking process may preferably be done in the temperature range of from 900 to 1,000° C. with the plates being pressed.

In the baking process, a baking adhesive can be applied to each plate. The baking adhesive can also be applied to between the filter member and the plate, but care should be paid not to block the liquid guide path.

Figure 5:
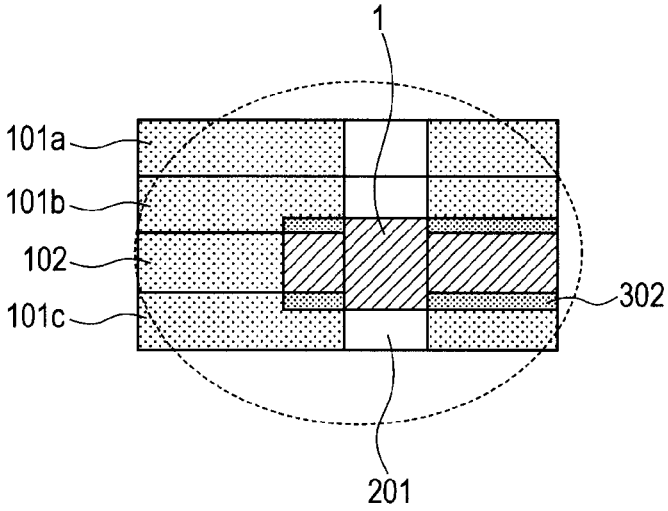
FIG. 5 is an enlarged sectional view of a circled portion A indicated by a dotted line in FIG. 4C.

Here, FIG. 5 is an enlarged sectional view of a circled portion A indicated by a dotted line in FIG. 4C. In FIG. 5, a filter bonding portion 302 is a portion where the filter member 1 is in contact with the second guide path plate 101*b* or the third guide path plate 101*c*. In this portion, the plates 101*b* and 101*c* having been softened penetrate and extend into the mesh-like filter member.

Figure 4D:
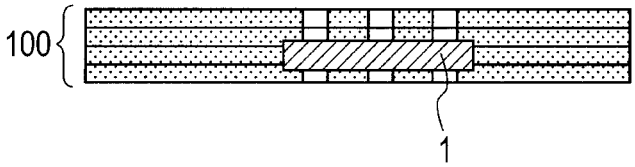

As described above, the laminate is pressed and baked using the filter member thicker than the filter plate, and thus the laminate can be formed so as to eliminate a gap between the filter member surfaces and the plates as shown in FIG. 4D. Accordingly, the filter member 1 is firmly fixed. Further, the recording element bonding surface of the support member 100 can conform to the surfaces of the pressing/baking jig 10 with high surface precision to increase the surface precision of the support member 100. Furthermore, ink droplets ejected from the ejection orifice of the recording element substrate 3 can be deposited onto a recording medium with good precision for performing the recording.

The thickness of the guide path plate can be, for example, 0.5 to 1.5 mm.

The thickness of the filter plate can be, for example, 0.5 to 1.5 mm. The thickness of the filter member can be, for example, 0.8 to 1.8 mm.

(Second Embodiment)

Now, a second embodiment of the present invention will be described. The following description of the second embodiment will focus on the differences from the first embodiment.

Figure 6:
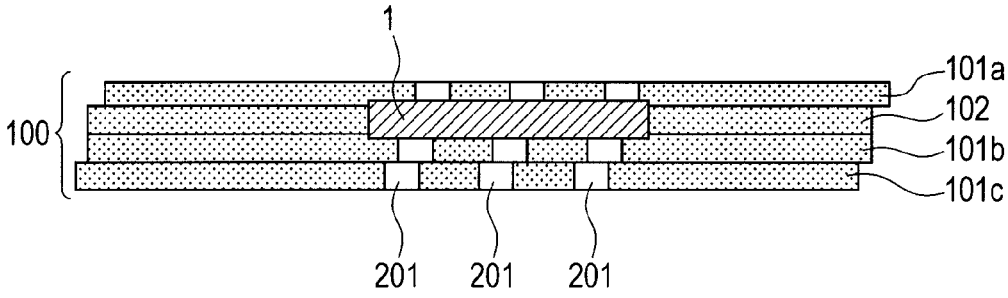
FIG. 6 is a sectional view of a support member according to a second embodiment of the present invention.

FIG. 6 is a sectional view of a support member 100 according to the second embodiment of the present invention. An ejection element substrate 3 is bonded to a first guide path plate 101*a*, which is the uppermost layer of a plurality of plates. Note that in the present description, the surface of the support member on which the ejection element substrate is to be disposed is referred to as a first surface and the surface of the support member on the side opposite thereto is referred to as a second surface.

As illustrated in FIG. 6, when a plurality of plates is stacked and baked, there may be a possibility that a shift in the bonding positions occurs between the plates, causing liquid flow stagnation. The configuration of the present embodiment is hardly affected by steps formed due to the shift in the bonding positions.

That is to say, in the laminate of the present embodiment, a guide path plate 101*a* is disposed on the first surface, and a filter plate 102 is disposed on and adjacent to the side of the guide path plate 101*a* opposite to the first surface, which guide path plate is disposed on the first surface.

Such a configuration prevents steps due to a shift in the bonding positions from occurring in an ink flow direction between the ejection element substrate 3 and the filter member 1, and thus allowing liquid flow stagnation to hardly occur. Even if insufficient cleaning due to the liquid flow stagnation caused by a shift in the bonding position occurs between the second guide path plate 101*b* and the third guide path plate 101*c*, which are disposed on the lower side of the filter plate 102, the filter member 1 can prevent foreign matters from entering the ejection element substrate 3. Thus, ink droplets can be ejected from the ejection orifice with good precision.

(Third Embodiment)

Now, a third embodiment of the present invention will be described.

FIGS. 7A, 7B, 7C, 7D, 7E, and 7F are views illustrating a method of forming a filter member 1 in a support member 100 according to the third embodiment.

Figure 7A:
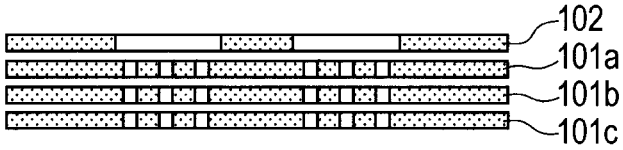
FIGS. 7A, 7B, 7C, 7D, 7E, and 7F are sectional views for describing a third embodiment of the present invention.

First, as illustrated in FIG. 7A, alumina plates before baking are provided with a through-hole serving as a liquid guide path to prepare guide path plates. In addition, another alumina plate before baking is provided with an opening for disposing a filter member to prepare a filter plate.

Figure 7B:
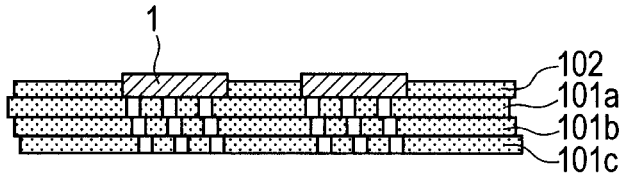

Then, as illustrated in FIG. 7B, a filter plate 102 having a filter member 1 disposed in the opening, a first guide path plate 101*a*, a second guide path plate 101*b*, and a third guide path plate 101*c* are stacked in this order from above.

Figure 7C:
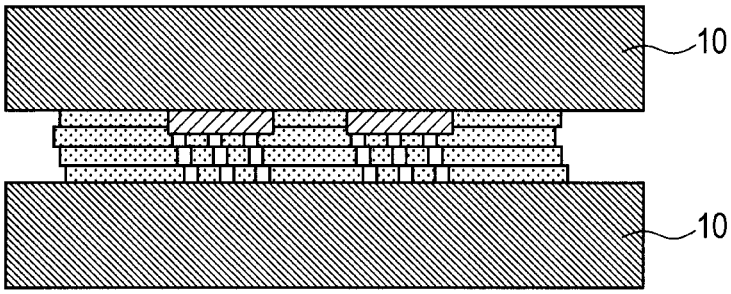

Then, as illustrated in FIG. 7C, the plates are pressed and baked by a pressing/baking jig 10.

The baking temperature is, for example, 900 to 1,000° C.

Figure 7D:
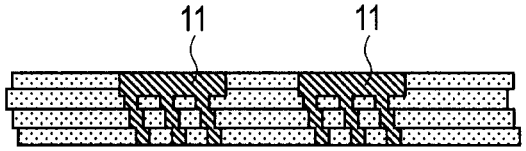

Then, as illustrated in FIG. 7D, in order to reduce foreign matters entering the liquid guide path and the filter member during a subsequent polishing process, the liquid guide path and the filter member are impregnated with a resin 11 which can be removed in a subsequent process. Examples of the removable resin include a hot melt resin.

Figure 7E:
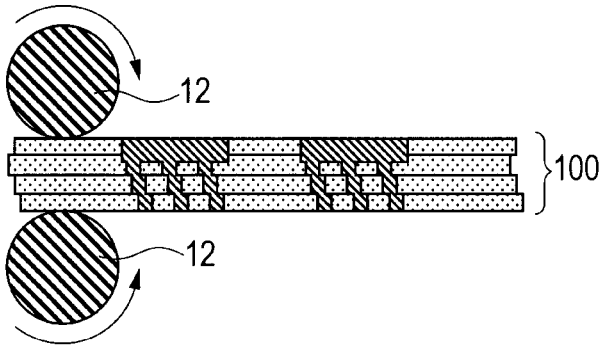

Then, as illustrated in FIG. 7E, the first surface and the second surface of the support member 100 as well as the filter member 1 built in the uppermost layer thereof are polished with a polishing jig 12.

Figure 7F:
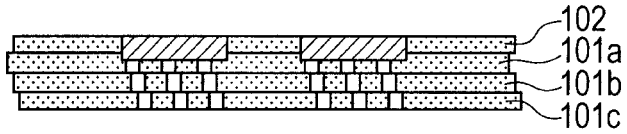

Then, as illustrated in FIG. 7F, the removable resin 11 is removed. When a hot melt removable resin is used, the resin is subjected to a heating treatment at about 1,000° C. after polishing, for example. Then, the removable resin 11 is melted by heating. Thus, the removable resin 11 is removed from the liquid guide path and the filter member.

Examples of the removable resin include a thermoplastic resin, a positive photosensitive resin, and a rubber-based resin.

The above method allows the support member surfaces to be polished while preventing polishing sludge or residue from entering the liquid guide path and the filter member and suppressing blocking of the filter member. Thus, a support member having a high surface precision can be formed.

Further, the support member according to the present embodiment is configured such that in the laminate, the filter plate and the filter member are disposed in the first surface on which the ejection element substrate is to be disposed. In other word, the filter member and the filter plate are disposed in the uppermost layer of the laminate.

(Fourth Embodiment)

Now, a fourth embodiment of the present invention will be described.

FIGS. 8A, 8B, 8C, 8D, 8E, and 8F are schematic views for describing a manufacturing method according to the fourth embodiment.

Figure 8A:
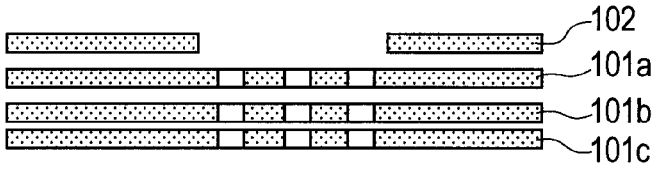
FIGS. 8A, 8B, 8C, 8D, 8E, and 8F are sectional views for describing a fourth embodiment of the present invention.

First, as illustrated in FIG. 8A, guide path plates 101*a*, 101*b* and 101*c*, which are produced by forming a through-hole serving as a liquid guide path in alumina plates before baking, are provided. Further, a filter plate 102, which is produced by forming an opening for disposing a filter member in another alumina plate before baking, is provided.

Figure 8B:
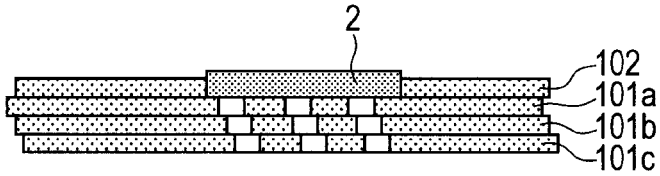

Then, as illustrated in FIG. 8B, a filter plate 102 having a filter substrate 2 disposed in the opening, a first guide path plate 101*a*, a second guide path plate 101*b*, and a third guide path plate 101*c* are stacked in this order from above.

Figure 8C:
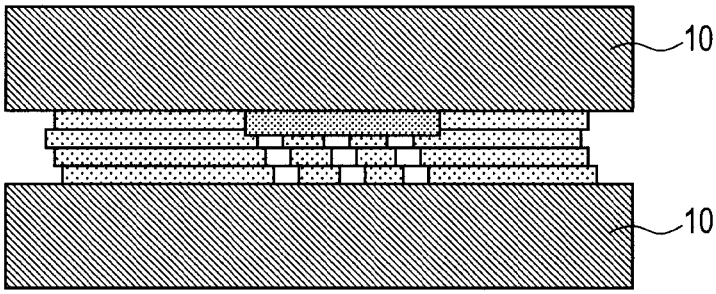

Then, as illustrated in FIG. 8C, the plates thus stacked are pressed and baked with a pressing/baking jig 10. The baking temperature is, for example, 900 to 1,000° C.

Figure 8D:
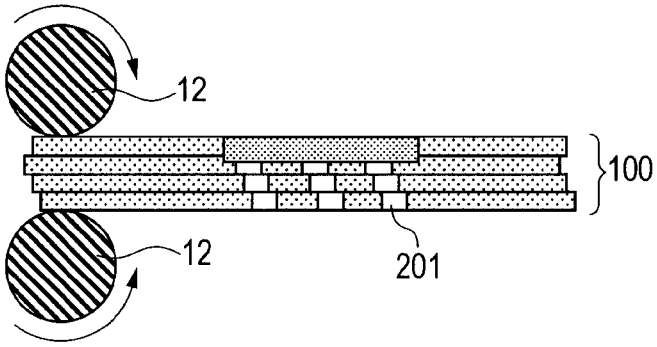

As illustrated in FIG. 8D, the surfaces of a support member 100 are then polished and planarized with a polishing jig 12.

Figure 8E:
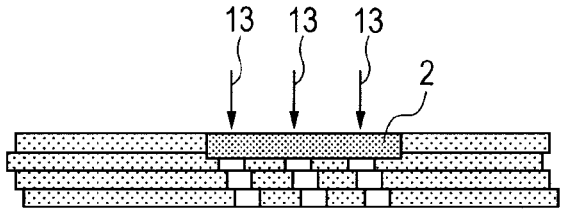

Then, as illustrated in FIG. 8E, the planarized filter substrate 2 is subjected to a perforating process 13. Examples of the perforating process include a laser process and an etching process.

Figure 8F:
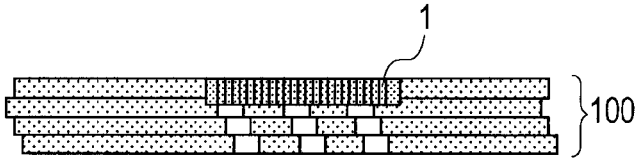

As illustrated in FIG. 8F, through the perforation, the filter substrate 2 becomes a filter member 1. Since the filter substrate 2 is subjected to the perforation process 13 after the polishing process, polishing sludge which might enter the liquid guide path can be reduced. According to the present embodiment, the size of the perforation process 13 performed in the filter substrate 2 is, for example, about 10 μm in diameter.

Thus, the above mentioned processes enable the support member 100 to have an increased surface precision, and ink droplets can be ejected from an ejection orifice of an ejection recording element substrate 3 to a recording medium with good precision. The present embodiment is configured such that the filter member 1 and the filter plate are disposed as the uppermost layer of the stacked plates. Note that on any layer, regardless of the position at which the filter member 1 is disposed, the perforation after the polishing process can exert a similar effect.

The present invention can provide a liquid ejection head including a laminate formed of a plurality of members stacked, having an increased bonding strength between a filter member and a support member, and being provided with a simple configuration for preventing contaminants in a liquid from entering the ejection element substrate. Further, the present invention can provide a manufacturing method which enables the production of such a liquid ejection head with good precision.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-248548, filed Nov. 5, 2010, which is hereby incorporated by reference herein in its entirety.

What is claimed is:

1. A liquid ejection head comprising:

an ejection element substrate having an energy generating element for generating energy for ejecting a liquid, an ejection orifice for ejecting the liquid, and a liquid supply port communicatively connected to the ejection orifice; and a support member supporting the ejection element substrate and having a liquid guide path for supplying the liquid to the liquid supply port, wherein the support member is formed by baking a laminate comprising at least two guide path plates having a through-hole for constituting a part of the liquid guide path, a filter plate having an opening for disposing a filter member for filtering the liquid, and the filter member disposed in the opening, the filter member being in contact with and sandwiched between the two guide path plates.

2. The liquid ejection head according to claim 1, wherein the ejection element substrate is provided in plural, the ejection element substrates are supported by the support member, and plural filter members are disposed one for one corresponding to each of the ejection element substrates.

3. The liquid ejection head according to claim 1, wherein the support member has one filter member for a plurality of the liquid guide paths for supplying the liquid to one ejection element substrate.

4. The liquid ejection head according to claim 1, wherein, in the laminate, one of the two guide path plates is disposed on a side of a first surface on which the ejection element substrate is disposed.

5. The liquid ejection head according to claim 4, wherein, in the laminate, the one of the two guide path plates is disposed on the first surface, and the filter plate is disposed adjacently on the side of the guide path plate opposite to the first surface.

6. The liquid ejection head according to claim 5, wherein, in the laminate, the other of the two guide path plates is further disposed on the side of the filter plate opposite to the first surface.

7. The liquid ejection head according to claim 1, wherein the filter member is made of an alloy of Fe, Cr, and Ni.

8. The liquid ejection head according to claim 1, wherein the support member is made of alumina.

9. A method of manufacturing a liquid ejection head comprising an ejection element substrate having an energy generating element for generating energy for ejecting a liquid, an ejection orifice for ejecting the liquid, and a liquid supply port communicatively connected to the ejection orifice; and a support member supporting the ejection element substrate and having a liquid guide path for supplying the liquid to the liquid supply port, the method comprising the steps of:

preparing a laminate comprising at least two guide path plates having a through-hole for constituting a part of the liquid guide path, a filter plate having an opening for disposing a filter member for filtering the liquid, and the filter member disposed in the opening; and integrating the laminate by baking the laminate, the filter member being in contact with and sandwiched between the two guide path plates.

10. The method of manufacturing a liquid ejection head according to claim 9, wherein the integrating step is a process of baking while pressing the laminate.

11. The method of manufacturing a liquid ejection head according to claim 9, wherein the filter member is thicker than the filter plate.

12. The method of manufacturing a liquid ejection head according to claim 9, wherein in the preparing step, one of the two guide path plates is disposed on a side of a first surface on which the ejection element substrate is disposed.

13. The method of manufacturing a liquid ejection head according to claim 12, wherein in the preparing step, the one of the two guide path plates is disposed on the first surface, and the filter plate is disposed adjacently on the side of the guide path plate opposite to the first surface.

14. The method of manufacturing a liquid ejection head according to claim 13, wherein in the preparing step, the other of the two guide path plates is further disposed on the side of the filter plate opposite to the first surface.

15. A method of manufacturing a liquid ejection head comprising an ejection element substrate having an energy generating element for generating energy for ejecting a liquid, an ejection orifice for ejecting the liquid, and a liquid supply port communicatively connected to the ejection orifice; and a support member supporting the ejection element substrate and having a liquid guide path for supplying the liquid to the liquid supply port, the method comprising the steps of:

preparing a laminate including at least two guide path plates having a through-hole for constituting a part of the liquid guide path, a filter plate having an opening for disposing a filter member for filtering the liquid, and the filter member disposed in the opening, the filter member is in contact with and sandwiched between the two guide path plates;

integrating the laminate by baking the laminate;

polishing the surface of the filter plate; and perforating the filter substrate to form the filter member, in this order.

* * * * *